US011428135B2

(12) United States Patent
Van Nieuwstadt et al.

(10) Patent No.: US 11,428,135 B2
(45) Date of Patent: Aug. 30, 2022

(54) SYSTEM AND METHOD FOR DETECTING RELEASE FROM AN INJECTOR

(71) Applicant: Ford Global Technologies, LLC, Dearborn, MI (US)

(72) Inventors: Michiel J. Van Nieuwstadt, Ann Arbor, MI (US); Paul Tennison, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/993,857

(22) Filed: Aug. 14, 2020

(65) Prior Publication Data

US 2022/0049636 A1 Feb. 17, 2022

(51) Int. Cl.

| | |
|---|---|
| ***F01N 3/00*** | (2006.01) |
| ***F01N 3/20*** | (2006.01) |
| ***F01N 3/36*** | (2006.01) |
| ***F01N 11/00*** | (2006.01) |
| ***F01N 3/035*** | (2006.01) |

(52) U.S. Cl.

CPC ..... *F01N 3/208* (2013.01); *F01N 3/035* (2013.01); *F01N 3/36* (2013.01); *F01N 11/002* (2013.01); *F01N 11/007* (2013.01); *F01N 2250/02* (2013.01); *F01N 2390/02* (2013.01); *F01N 2430/08* (2013.01); *F01N 2560/025* (2013.01); *F01N 2560/06* (2013.01); *F01N 2610/03* (2013.01); *F01N 2610/1453* (2013.01); *F01N 2900/12* (2013.01); *F01N 2900/1404* (2013.01); *F01N 2900/1411* (2013.01); *F01N 2900/1602* (2013.01)

(58) Field of Classification Search

CPC ..... F01N 3/208; F01N 3/035; F01N 11/007; F01N 11/002; F01N 3/36; F01N 2900/1602; F01N 2610/1453; F01N 2560/06; F01N 2900/1411; F01N 2900/12; F01N 2900/1404; F01N 2610/03; F01N 2430/08; F01N 2250/02; F01N 2390/02; F01N 2560/025

See application file for complete search history.

(56) References Cited

U.S. PATENT DOCUMENTS

| | | | | |
|---|---|---|---|---|
| 6,487,852 | B1 * | 12/2002 | Murphy | B01D 53/9431 60/286 |
| 7,159,551 | B2 | 1/2007 | Cecur et al. | |
| 7,404,383 | B2 | 1/2008 | Elendt | |
| 8,561,387 | B2 * | 10/2013 | Fokkelman | F01N 3/2073 60/276 |
| 9,010,087 | B1 * | 4/2015 | Upadhyay | F01N 3/208 60/277 |
| 9,605,603 | B2 | 3/2017 | Glugla et al. | |
| 2003/0046928 | A1 * | 3/2003 | van Nieuwstadt | F02D 41/221 60/286 |

(Continued)

*Primary Examiner* — Matthew T Largi

(74) *Attorney, Agent, or Firm* — Vincent Mastrogiacomo; McCoy Russell LLP

(57) ABSTRACT

Methods and systems for operating an engine that includes a catalyst and a particulate filter are described. In one example, release of reductant from an injector may be determined according to a plurality of metrics so that reliability of a release indication may be improved. In addition, operation of an engine may be adjusted responsive to the release indication so that exhaust system temperatures may be maintained.

18 Claims, 3 Drawing Sheets

(56) References Cited

U.S. PATENT DOCUMENTS

| | | | | |
|---|---|---|---|---|
| 2003/0051468 | A1* | 3/2003 | Van Nieuwstadt | B01D 53/9495 60/286 |
| 2004/0221571 | A1* | 11/2004 | Lewis, Jr. | F01N 11/002 60/277 |
| 2005/0103099 | A1* | 5/2005 | van Nieuwstadt | F01N 3/2066 73/114.77 |
| 2009/0229586 | A1* | 9/2009 | Post | F02D 41/0007 123/699 |
| 2010/0186385 | A1* | 7/2010 | Gonze | F01N 9/00 60/286 |
| 2010/0300071 | A1* | 12/2010 | Post | F01N 9/002 60/274 |
| 2011/0023590 | A1* | 2/2011 | Van Nieuwstadt | F02D 41/1447 73/114.73 |
| 2015/0113960 | A1 | 4/2015 | Ruth et al. | |
| 2015/0128564 | A1* | 5/2015 | Upadhyay | F01N 3/2066 60/274 |

* cited by examiner

SYSTEM AND METHOD FOR DETECTING RELEASE FROM AN INJECTOR

BACKGROUND/SUMMARY

An exhaust after treatment system may include a lean NOx trap (LNT) for capturing NOx and/or a diesel exhaust catalyst (e.g., an oxidation catalyst) that is located upstream of a particulate filter. The NOx that is held in the NOx trap may be converted into $N_2$ and $H_2O$ and $CO_2$ by introducing a reductant upstream of the NOx trap. Oxidation of carbonaceous soot in the particulate filter may be facilitated by heating the particulate filter via oxidizing reductant that enters the diesel exhaust catalyst upstream of the particulate filter. In particular, heat from the diesel exhaust catalyst may flow to the particulate filter so that the carbonaceous soot within the particulate filter may be oxidized. Reductant, such as hydrocarbons, may be introduced upstream of the NOx trap or upstream of the oxidation catalyst via an injector so that NOx in the LNT may be converted or so that soot in the particulate filter may be oxidized. Some injectors may degrade and release hydrocarbons into the exhaust system unintentionally. The hydrocarbons may be unintentionally released when it is not desirable to purge the LNT (e.g., reduce NOx in the LNT) or regenerate the particulate filter (e.g., oxidize soot in the particulate filter). Consequently, the hydrocarbons may be wasted and criterion emissions may be increased.

The inventors herein have recognized the above-mentioned disadvantages and have developed an engine operating method, comprising: generating a plurality of metrics via a controller, the plurality of metrics including an oxygen concentration difference and a temperature difference across an emissions device; and adjusting engine operation in response to a release of reductant from an injector positioned in an exhaust system, where the release is based on the plurality of metrics being compared to one or more thresholds that are functions of one or more engine parameters.

By adjusting engine operation in response to a plurality of metrics, it may be possible to reliably determine release of reductant from an injector when the injector is not commanded open. For example, if an oxygen concentration difference across an injector is greater than a threshold while an exothermic reaction is indicated across a diesel exhaust catalyst, then an indication of release of reductant from an injector may be indicated. Once release of reductant is determined, operation of an engine may be adjusted to lower exhaust temperatures and an indication of released reductant may be provided to vehicle occupants so that the vehicle may be serviced to reduce waste of reductant.

The present description may provide several advantages. In particular, the approach may reduce waste of reductant and undesired tail pipe emissions levels. In addition, the approach may limit exhaust temperatures to reduce a possibility of after treatment device degradation. Further, the approach may improve accuracy of determining the presence or absence of reductant release.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The present description is related to operating an engine exhaust gas after treatment system that includes an injector. In one example, the injector may selectively inject a reductant (e.g., hydrocarbons such as diesel fuel) to an exhaust system of the type shown in FIG. 1. Release of reductant from the injector without commanding the injector open may be determined according to a sequence as shown in FIG. 2. The sequence of FIG. 2 may be provided via the method of FIG. 3 in conjunction with the system of FIG. 1.

Figure 1:
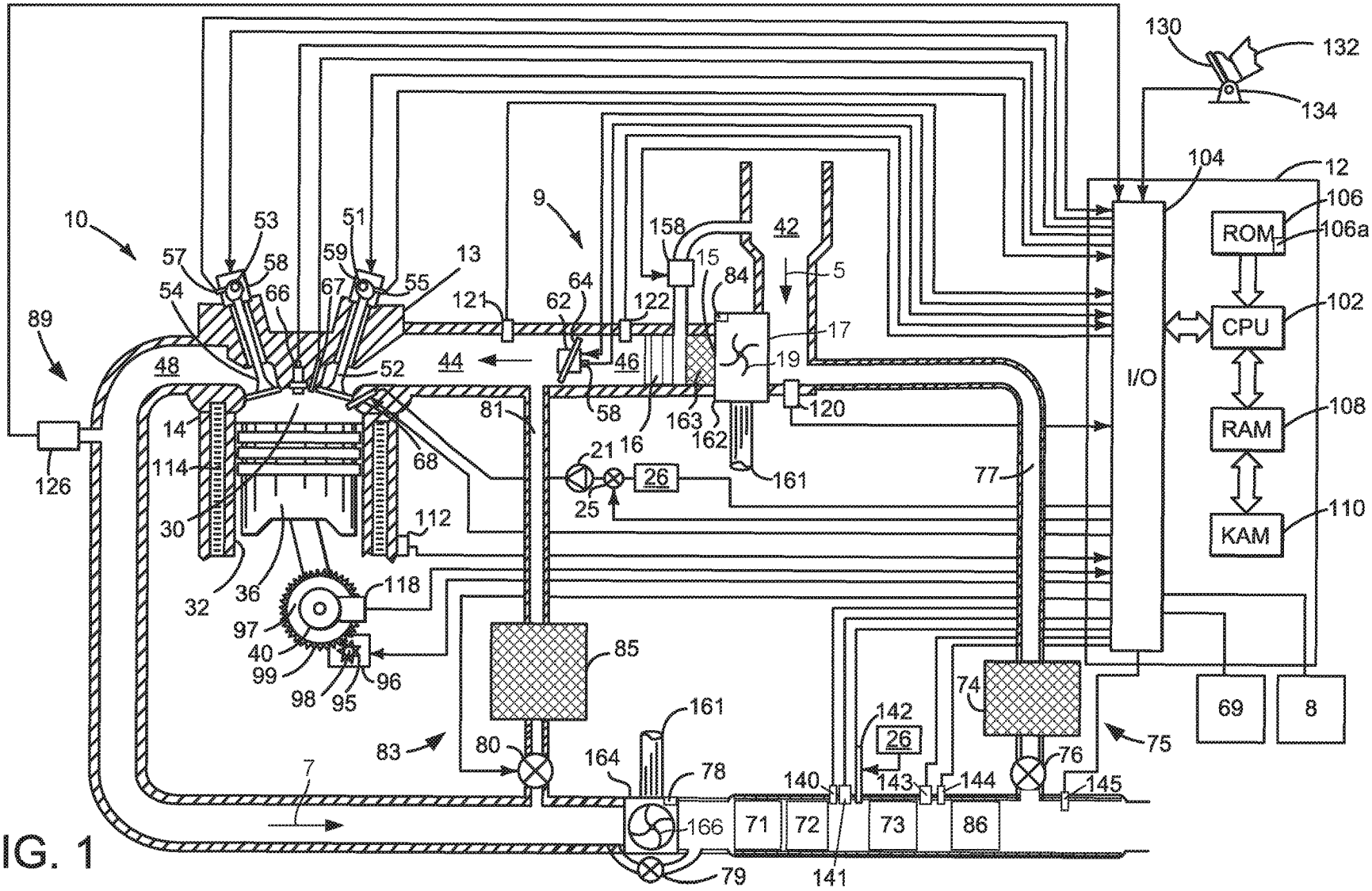
FIG. 1 shows a detailed schematic depiction of an example engine.
Figure 2:
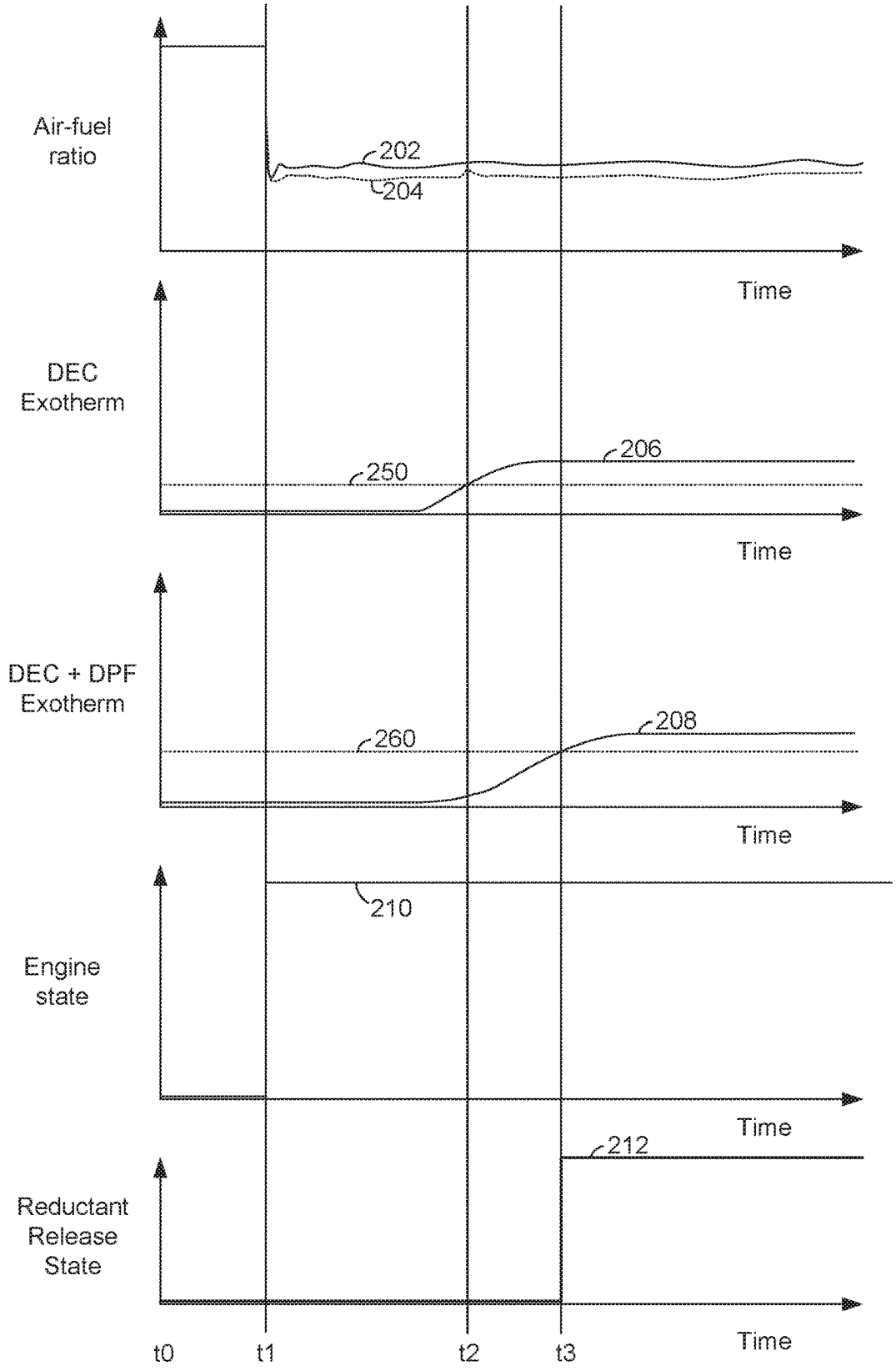
FIG. 2 shows an example sequence according to the method of FIG. 3.

Referring to FIG. 1, internal combustion engine 10, comprising a plurality of cylinders, one cylinder of which is shown in FIG. 1, is controlled by electronic engine controller 12. The controller 12 receives signals from the various sensors of FIG. 1 and employs the various actuators of FIG. 1 to adjust engine operation based on the received signals and instructions stored on a memory of the controller.

Engine 10 includes combustion chamber 30 and cylinder walls 32 with piston 36 positioned therein and connected to crankshaft 40. Cylinder head 13 is fastened to engine block 14. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Although in other examples, the engine may operate valves via a single camshaft or pushrods. The position of intake cam 51 may be determined by intake cam sensor 55. The position of exhaust cam 53 may be determined by exhaust cam sensor 57. Intake poppet valve 52 may be operated by a variable valve activating/deactivating actuator 59, which may be a cam driven valve operator (e.g., as shown in U.S. Pat. Nos. 9,605,603; 7,404,383; and 7,159,551 all of which are hereby fully incorporated by reference for all purposes). Likewise, exhaust poppet valve 54 may be operated by a variable valve activating/deactivating actuator 58, which may a cam driven valve operator (e.g., as shown in U.S. Pat. Nos. 9,605,603; 7,404,383; and 7,159,551 all of which are hereby fully incorporated by reference for all purposes). Intake poppet valve 52 and exhaust poppet valve 54 may be deactivated and held in a closed position preventing flow into and out of cylinder 30 for one or more entire engine cycles (e.g. two engine revolutions), thereby deactivating cylinder 30. Flow of fuel supplied to cylinder 30 may also cease when cylinder 30 is deactivated.

Fuel injector 68 is shown positioned in cylinder head 13 to inject fuel directly into combustion chamber 30, which is known to those skilled in the art as direct injection. Fuel is delivered to fuel injector 68 by a fuel system including a fuel tank 26, fuel pump 21, fuel pump control valve 25, and fuel rail (not shown). Fuel pressure delivered by the fuel system may be adjusted by varying a position valve regulating flow to a fuel pump (not shown). In addition, a metering valve may be located in or near the fuel rail for closed loop fuel control. A pump metering valve may also regulate fuel flow to the fuel pump, thereby reducing fuel pumped to a high pressure fuel pump.

Engine air intake system 9 includes intake manifold 44, throttle 62, grid heater 16, charge air cooler 163, turbocharger compressor 162, and intake plenum 42. Intake manifold 44 is shown communicating with optional electronic throttle 62 which adjusts a position of throttle plate 64 to control air flow from intake boost chamber 46. Compressor 162 draws air from air intake plenum 42 to supply boost chamber 46. Compressor vane actuator 84 adjusts a position of compressor vanes 19. Exhaust gases spin turbine 164 which is coupled to turbocharger compressor 162 via shaft 161. In some examples, a charge air cooler 163 may be provided. Further, an optional grid heater 16 may be provided to warm air entering cylinder 30 when engine 10 is being cold started.

Compressor speed may be adjusted via adjusting a position of turbine variable vane control actuator 78 or compressor recirculation valve 158. In alternative examples, a waste gate 79 may replace or be used in addition to turbine variable vane control actuator 78. Turbine variable vane control actuator 78 adjusts a position of variable geometry turbine vanes 166. Exhaust gases can pass through turbine 164 supplying little energy to rotate turbine 164 when vanes are in an open position. Exhaust gases can pass through turbine 164 and impart increased force on turbine 164 when vanes are in a closed position. Alternatively, wastegate 79 or a bypass valve may allow exhaust gases to flow around turbine 164 so as to reduce the amount of energy supplied to the turbine. Compressor recirculation valve 158 allows compressed air at the outlet 15 of compressor 162 to be returned to the inlet 17 of compressor 162. Alternatively, a position of compressor variable vane actuator 78 may be adjusted to change the efficiency of compressor 162. In this way, the efficiency of compressor 162 may be reduced so as to affect the flow of compressor 162 and reduce the possibility of compressor surge. Further, by returning air back to the inlet of compressor 162, work performed on the air may be increased, thereby increasing the temperature of the air. Air flows into engine 10 in the direction of arrows 5.

Flywheel 97 and ring gear 99 are coupled to crankshaft 40. Starter 96 (e.g., low voltage (operated with less than 30 volts) electric machine) includes pinion shaft 98 and pinion gear 95. Pinion shaft 98 may selectively advance pinion gear 95 to engage ring gear 99 such that starter 96 may rotate crankshaft 40 during engine cranking. Starter 96 may be directly mounted to the front of the engine or the rear of the engine. In some examples, starter 96 may selectively supply torque to crankshaft 40 via a belt or chain. In one example, starter 96 is in a base state when not engaged to the engine crankshaft. An engine start may be requested via human/machine interface (e.g., key switch, pushbutton, remote radio frequency emitting device, etc.) 69 or in response to vehicle operating conditions (e.g., brake pedal position, accelerator pedal position, battery SOC, etc.). Battery 8 may supply electrical power to starter 96. Controller 12 may monitor battery state of charge. Combustion is initiated in the combustion chamber 30 when fuel automatically ignites via combustion chamber temperatures reaching the auto-ignition temperature of the fuel that is injected to cylinder 30. The temperature in the cylinder increases as piston 36 approaches top-dead-center compression stroke. Exhaust gases may be processed via exhaust system 89, which may include sensors and emissions control devices as described herein. In some examples, a universal Exhaust Gas Oxygen (UEGO) sensor 126 may be coupled to exhaust manifold 48 upstream of emissions device 71. In other examples, the UEGO sensor may be located downstream of one or more exhaust after treatment devices. Further, in some examples, the UEGO sensor may be replaced by a NOx sensor that has both NOx and oxygen sensing elements.

At lower engine temperatures optional glow plug 66 may convert electrical energy into thermal energy so as to create a hot spot next to one of the fuel spray cones of an injector in the combustion chamber 30. By creating the hot spot in the combustion chamber next to the fuel spray 30, it may be easier to ignite the fuel spray plume in the cylinder, releasing heat that propagates throughout the cylinder, raising the temperature in the combustion chamber, and improving combustion. Cylinder pressure may be measured via optional pressure sensor 67, alternatively or in addition, sensor 67 may also sense cylinder temperature. Exhaust temperature may be determined via temperature sensor 91.

Emissions device 71 may include an oxidation catalyst and it may be followed by a selective catalytic reduction (SCR) catalyst or other exhaust gas after treatment device. Exhaust system 89 may also include a diesel exhaust catalyst (DEC) 73 and a diesel particulate filter (DPF) 86. The DEC 73 may be positioned upstream of the DPF 86 so that heat from the DEC 73 may be transferred to the DPF 86 during DPF regeneration (e.g., oxidation of soot within the DPF). In other examples, a LNT may be placed at 73 or 86. Exhaust flows in the direction that is indicated by arrow 7.

Exhaust system 89 also includes a temperature sensor 140 and an oxygen sensor 141 that are positioned upstream of injector 142 according to the direction of exhaust flow. Exhaust system 89 also includes a downstream oxygen sensor 143, a first downstream temperature sensor 144, and a second downstream temperature sensor 145. Injector may inject a reductant (e.g., diesel fuel) from tank 26. An exhaust gas air-fuel ratio differential may be determined across injector 142 by subtracting an air-fuel ratio sensed via oxygen sensor 141 from an air-fuel ratio sensed by oxygen sensor 143. In some examples, oxygen sensor 143 may be positioned downstream of DPF 86. Alternatively, an exhaust gas oxygen concentration differential may be determined across injector 142 by subtracting an oxygen concentration sensed via oxygen sensor 141 from an oxygen concentration sensed by oxygen sensor 143. A temperature differential across DEC 73 may be determined by subtracting a temperature observed by temperature sensor 144 from a temperature observed by temperature sensor 140. In addition, a temperature differential across DEC 73 and DPF 86 may be determined by subtracting a temperature observed by temperature sensor 145 from a temperature observed by temperature sensor 140.

Exhaust gas recirculation (EGR) may be provided to the engine via high pressure EGR system 83. High pressure EGR system 83 includes valve 80, EGR passage 81, and EGR cooler 85. EGR valve 80 is a valve that closes or allows exhaust gas to flow from upstream of emissions device 71 to a location in the engine air intake system downstream of compressor 162. EGR may be cooled via passing through EGR cooler 85. EGR may also be provided via low pressure EGR system 75. Low pressure EGR system 75 includes EGR passage 77 and EGR valve 76. Low pressure EGR may flow from downstream of DPF 86 to a location upstream of compressor 162. Low pressure EGR system 75 may include an EGR cooler 74.

Controller 12 is shown in FIG. 1 as a conventional microcomputer including: microprocessor unit 102, input/ output ports 104, read-only memory (e.g., non-transitory memory) 106, random access memory 108, keep alive memory 110, and a conventional data bus. Read-only memory 106 may include a plurality of software modules 106*a* that perform specific engine control functions (e.g., fuel injection control, EGR control, emissions control). Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to a torque or power demand pedal 130 for sensing pedal position adjusted by human foot 132; a measurement of engine manifold pressure (MAP) from pressure sensor 121 coupled to intake manifold 44 (alternatively or in addition sensor 121 may sense intake manifold temperature); boost pressure from pressure sensor 122 exhaust gas oxygen concentration from oxygen sensor 126; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In some examples, fuel may be injected to a cylinder a plurality of times during a single cylinder cycle.

In a process hereinafter referred to as ignition, the injected fuel is ignited by compression ignition resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, or various other examples. Further, in some examples a two-stroke cycle may be used rather than a four-stroke cycle.

Thus, the system of FIG. 1 provides for an engine system, comprising: an internal combustion engine; an after treatment system coupled to the internal combustion engine, the after treatment system including an oxidation catalyst, a particulate filter, and an injector; a first oxygen sensor positioned in the after treatment system upstream of the injector and a second oxygen sensor positioned in the after treatment system downstream of the injector; a first temperature sensor positioned upstream of the oxidation catalyst and a second temperature sensor positioned downstream of the oxidation catalyst, and a third temperature sensor positioned downstream of the particulate filter. The engine system includes where the second oxygen sensor is positioned downstream of the DEC. The engine system further comprises a controller including executable instructions stored in non-transitory memory that cause the controller to generate a plurality of metrics for assessing release from the injector. The engine system includes where the plurality of metrics includes a change in oxygen concentration and a temperature difference across the oxidation catalyst. The engine system further comprises additional executable instructions to compare the plurality of metrics to a plurality of thresholds. The engine system includes where the plurality of thresholds are based on exhaust flow rate, ambient temperature, and ambient pressure. The engine system further comprises additional executable instructions for a counter including a count value that increases as a function of a metric's deviation from a threshold value, and instructions to indicate release from the injector responsive to the count value exceeding a threshold count value.

Turning now to FIG. 2, an example prophetic sequence for determining the presence or absence of release of reductant from an injector is shown. The sequence of FIG. 2 may be provided via the system of FIG. 1 and the method of FIG. 3. The operating sequence of FIG. 2 may be provided via the system of FIG. 1 executing instructions according to the method of FIG. 3 that are stored in non-transitory memory. Vertical markers t0-t3 represent times of interest during the sequence. All plots in FIG. 2 are aligned in time and occur at a same time.

The first plot from the top of FIG. 2 is a plot of air-fuel ratio as determined via an oxygen sensor in the engine's exhaust system versus time. Alternatively, oxygen concentration may be substituted for air-fuel ratio. The vertical axis represents air-fuel ratio as determined from an oxygen sensor. The air-fuel ratio increases (e.g., becomes leaner) in the direction of the vertical axis arrow. The horizontal axis represents time and time increases from the left side of the plot to the right side of the plot. Curve 202 represents the air-fuel ratio in the engine exhaust gases as determined via an oxygen sensor that is positioned upstream of a reductant injector. Curve 204 represents the air-fuel ratio in the engine exhaust gases as determined via an oxygen sensor that is positioned downstream of a reductant injector.

The second plot from the top of FIG. 2 is a plot of a DEC exotherm (e.g., a temperature increase across a DEC as determined via subtracting an exhaust temperature upstream of a DEC from an exhaust temperature downstream of the DEC) temperature increase versus time. The vertical axis indicates DEC exotherm temperature and the exotherm temperature increases in the direction of the vertical axis arrow. The horizontal axis represents time and time increases from the left side of the plot to the right side of the plot. Curve 206 represents the DEC exotherm. Line 250 represents a DEC threshold, which if exceeded by a DEC exotherm temperature, may be indicative of release of reductant from an injector.

The third plot from the top of FIG. 2 is a plot of a DEC+DPF exotherm (e.g., a temperature increase across a DEC and DPF as determined via subtracting an exhaust temperature upstream of a DEC from an exhaust temperature downstream of the DPF) temperature versus time. The vertical axis indicates DEC+DPF exotherm temperature and the exotherm temperature increases in the direction of the vertical axis arrow. The horizontal axis represents time and time increases from the left side of the plot to the right side of the plot. Curve 208 represents the DEC+DPF exotherm. Line 260 represents a DPF threshold, which if exceeded by a DEC+DPF exotherm temperature, may be indicative of release of reductant from an injector.

The fourth plot from the top of FIG. 2 is a plot of engine operating state versus time. The vertical axis represents engine operating state and the engine is on (e.g., rotating and combusting fuel) when trace 210 is at a higher level near the vertical axis arrow. The engine is not on, or is off, when trace 210 is at a lower level near the horizontal axis. The horizontal axis represents time and time increases from the left side of the plot to the right side of the plot. Line 210 indicates the engine state.

The fifth plot from the top of FIG. 2 is a plot of reductant release state from an injector in an exhaust system versus time. The vertical axis represents reductant release state from an injector in an exhaust system and reductant release is indicated when trace 212 is at a higher level near the vertical axis arrow. The reductant is not indicated being released from an injector when trace 212 is at a lower level near the horizontal axis. The horizontal axis represents time and time increases from the left side of the plot to the right side of the plot. Line 212 indicates the reductant release state. The injector in the exhaust system is not commanded to inject reductant during the sequence of FIG. 2.

At time t0, the engine is stopped and the air-fuel ratio is very lean indicating that the engine is not combusting air and fuel. The DEC exotherm temperature is zero and the DEC+DPF exotherm temperature is zero. Reductant release from the injector is not indicated.

At time t1, the engine is started and it begins to combust air and fuel as indicated by the engine state transitioning to a high level. The upstream air-fuel ratio in the exhaust system indicates a leaner air-fuel ratio than the downstream air-fuel ratio in the exhaust system. The richer downstream air-fuel ratio may be indicative of release of reductant. The DEC exotherm temperature is zero and the DEC+DPF exotherm temperature is zero. Reductant release from the injector is not indicated.

Between time t1 and time t2, the engine remains activated and the downstream air-fuel ratio remains richer than the upstream air-fuel ratio. The DEC exotherm temperature begins to increase near time t2. The DEC+DPF exotherm temperature also begins to increase near time t2. Reductant release from the injector is not indicated.

At time t2, the engine remains activated and the downstream air-fuel ratio remains richer than the upstream air-fuel ratio. The DEC exotherm temperature increases to a level above threshold 250, but reductant release is not indicated because the DEC+DPF exotherm temperature remains below threshold 260. A small decrease in O2 concentration between the upstream and downstream O2 sensors occurs since reductant is released.

At time t3, the engine remains activated and the downstream air-fuel ratio remains richer than the upstream air-fuel ratio. The DEC exotherm temperature remains above threshold 250 and the DEC+DPF exotherm temperature exceeds threshold 260. Therefore, reductant release from the injector is indicated. The exhaust air-fuel ratio, DEC exotherm temperature, and the DEC+DPF exotherm temperature all indicate that reductant is being released to the exhaust system. The reductant may richen an air-fuel ratio downstream of a reductant injector, increase a DEC exotherm temperature, and increase a DEC+DPF exotherm temperature when the reductant is diesel fuel and exhaust gas temperatures are sufficient to combust the diesel fuel within the DEC. In addition, by confirming reductant release based on three metrics (e.g., air-fuel ratio change, DEC exotherm temperature, and DEC+DPF exotherm temperature), it may be possible to provide a higher degree of confidence in the reductant release indication. For example, an air-fuel ratio difference may be caused by sensor bias, but an air-fuel ratio difference accompanied by a DEC exotherm and a DEC+DPF exotherm may indicate combustion of fuel from a richened air-fuel mixture. Thus, the air-fuel ratio difference combined with exotherm temperature increases may increase a confidence level to indicate release from an injector.

Thus, it may be possible to improve an assessment of release from an injector based on a plurality of metrics (e.g., air-fuel ratio difference, exotherm temperature difference, etc.). Further, by applying a plurality of metrics to be a basis for injector release assessments, it may provide an improved level of confidence when determining the presence or absence of release from an injector.

Figure 3:
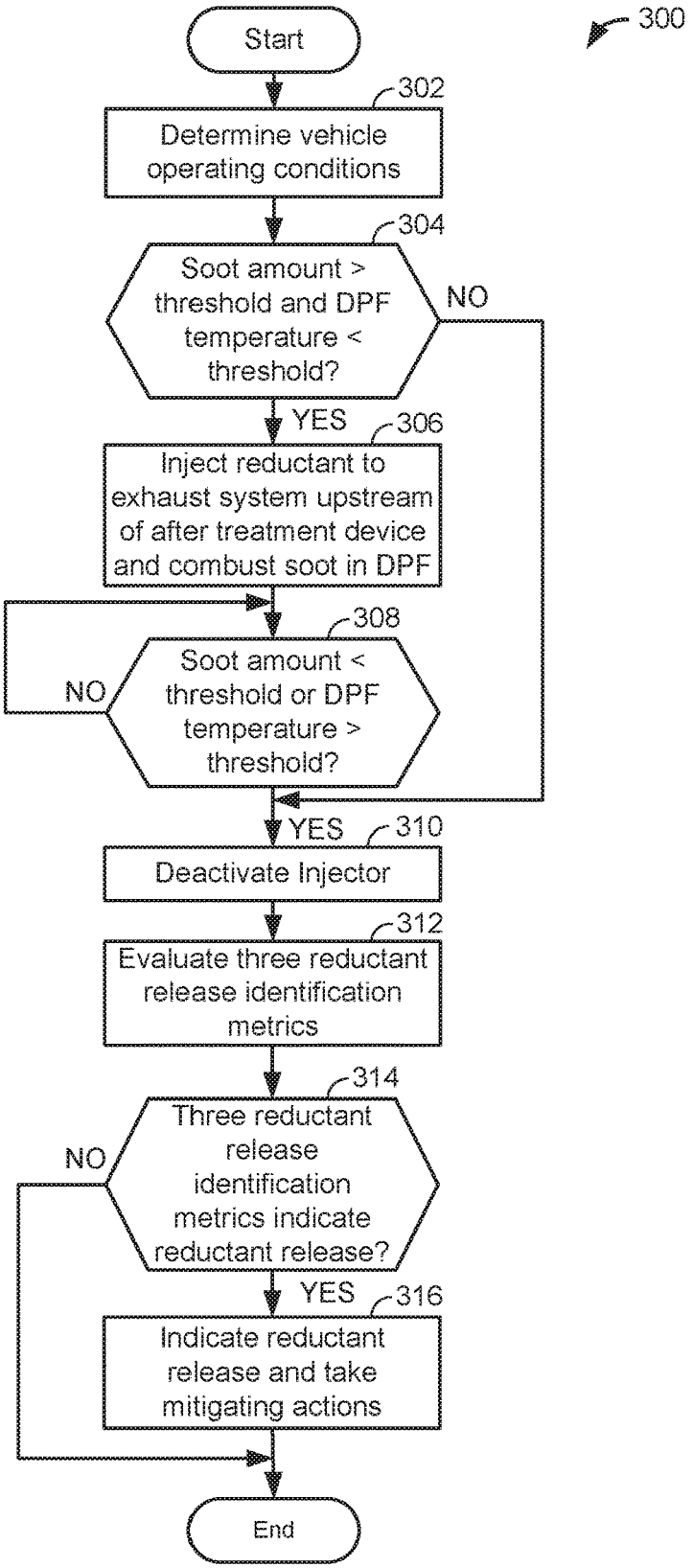
FIG. 3 shows an example method for determining release of reductant from an injector in a system that includes a particulate filter.

Referring now to FIG. 3, a method for operating an engine that includes an injector in an exhaust system is shown. The method of FIG. 3 may be stored as executable instructions in non-transitory memory of a controller in systems such as are shown in FIG. 1. The method of FIG. 3 may be incorporated into and may cooperate with the systems of FIG. 1. Further, portions of the method of FIG. 3 may be performed via a controller transforming operating states of devices and actuators in the physical world. The controller may employ engine actuators of the engine system to adjust engine operation according to the method described below. Further, method 300 may determine selected control parameters as described below from sensor inputs.

At 302, method 300 determines vehicle operating conditions. Vehicle operating conditions may include but are not limited to DPF soot load, DPF temperature, DEC temperature, engine feed gas temperature (e.g., temperature of exhaust gas exiting the engine and entering an exhaust system), ambient temperature, ambient pressure, exhaust system temperatures, and exhaust flow rates. Method 300 proceeds to 304.

At 304, method 300 judges if an amount of carbonaceous soot stored in a DPF is greater than a threshold amount of soot and if DPF temperature is less than a threshold temperature. If method 300 judges that an amount of carbonaceous soot stored in a DPF is greater than a threshold amount of soot and if DPF temperature is less than a threshold temperature, the answer is yes and method 300 proceeds to 306. Otherwise, the answer is no and method 300 proceeds to 310.

At 306, method 300 injects reductant to the exhaust system via an injector. The injector may be positioned upstream of a DEC. By injecting reductant (e.g., diesel fuel) into the exhaust system upstream of the DEC, the reductant may be oxidized with the DEC causing the DEC temperature to increase. In addition, a temperature of exhaust gases entering the DEC may be increased as reductant is oxidized within the DEC so that heat may be transferred from the DEC to a downstream DPF. By increasing a temperature of the downstream DPF, it may be possible to oxidize soot held in the DPF so that an amount of soot stored in the DPF decreases. The carbonaceous soot may be oxidized into $CO_2$. Method 300 proceeds to 308.

At 308, method 300 judges if an amount of carbonaceous soot stored in the DPF is less than a threshold amount. Method 300 may judge an amount of soot that is held in the DPF based on a pressure drop across the DPF and an exhaust flow rate through the DPF. If method 300 judges that the amount of soot stored in the DPF is less than a threshold, the answer is yes and method 300 proceeds to 310. Otherwise, the answer is no and method 300 returns to 308.

At 310, method 300 deactivates the injector by commanding the injector closed. Method 300 proceeds to 312.

At 312, method 300 generates a plurality of metrics for evaluating the presence or absence of release from an injector. In one example, method 300 determines the following metrics:

$$M1=O2_pre_inj-O2_\text{post_in}$$

$$M2=T_\text{post}_DEC-T_pre_DEC$$

$$M3=T_\text{post}_DPF-T_pre_DEC$$

where M1 is a first metric that is based on output of an oxygen sensor, O2_pre_inj is output of the oxygen sensor that is upstream of the reductant injector, O2_post_inj is output of the oxygen sensor that is downstream of the reductant injector and downstream of the DEC or DPF, M2 is a second metric that is based on an exotherm temperature generated across a diesel exhaust catalyst, T_post_DEC is a temperature downstream of the DEC, T_pre_DEC is a temperature upstream of the DEC, M3 is a third metric that is based on an exotherm temperature generated across the DEC and the DPF, T_post_DPF is a temperature downstream of the DPF, and T_pre_DEC is a temperature upstream of the DEC.

The M1 metric indicates a difference in oxygen concentration, or alternatively, a difference in air-fuel ratio as determined from the oxygen sensor outputs. The M1 metric may indicate release of reductant over the expected temperature range of the vehicle. However, the M1 metric may have a lower reductant release detection capability due to oxygen sensor tolerances. The M2 metric may indicate an exothermic temperature increase and it may be highly sensitive to detecting reductant release. However, the exothermic temperature increase may be present only when the DEC is operating at higher temperatures. The M3 metric may be the least sensitive to detecting reductant release, but it may provide useful data if the post DEC temperature is biased low and not indicating a DEC exotherm. For example, if T_pre_DEC=500° C.; T_post_DEC=700° C. due to sensor bias, but actual post DEC temp is 800° C.; and T_post_DPF=800° C.; then M2=200° C. and M3=300° C. If reductant release is indicated when the metric M2 is greater than 240° C., then release would not be indicated. However, if a new metric is generated that is the sum of M2 and M3, and if its value is judged to be greater than a second threshold of 2·240° C.=480° C., then release of reductant may be indicated. Method 300 proceeds to 314.

At 314, method 300 judges whether or not reductant release is to be indicated based on the metrics determined at 312. In one example, method 300 may judge if release of reductant is present according to the following assessment: If M1>thr1 AND M2>thr2 AND M3>thr3, then release of reductant may be indicated, where AND is a logical "and" operation, thr1 is a first threshold that may be a function of exhaust flow rate, ambient pressure, ambient temperature, and exhaust feed gas temperature; thr2 is a second threshold that may be a function of exhaust flow, ambient pressure, ambient temperature, and exhaust feed gas temperature; thr3 is a third threshold that may be a function of exhaust flow, ambient pressure, ambient temperature, and exhaust feed gas temperature. In one example, the thresholds thr1-thr3 may be configured such that at low ambient temperatures (e.g., <20° C.), thr2 and thr3 are equal to a low number (e.g., −50° C.) so that M2>thr2 AND M3>thr3 are always satisfied and so that the decision as to whether or not reductant is released from the injector is driven by M1>thr1. In addition, the threshold thr1 may be defined such that a small indication of a difference in oxygen sensor outputs is satisfied at higher ambient temperatures (e.g., >5° C.) while larger values of M2 and M3 may be required to indicate release of reductant from the injector at the higher ambient temperatures.

In another example, metrics M1-M3 may be sub-metrics of an overall metric g. For example, the overall metric g(M1, M2, M3) may be a function of M1, M2, and M3. If g(M1, M2, M3)>thr4, then release of reductant from the injector may be indicated. The threshold thr4 may be a function of exhaust flow rate, ambient pressure, ambient temperature, and exhaust feed gas temperature. In addition, an average of the function g may be determined over a predetermined time period (e.g., 2 minutes), and release of reductants may be based on the average value of g over the time period.

In still another example, method 300 may judge whether or not release of reductant is present according to detection capabilities of the metrics. For example, a reductant release counter may be generated via the controller as follows:

$$Rel_cnt=Rel_cnt+inc(M1-thr1)+inc(M2-thr2)+inc(M3-thr3)$$

where Rel_cnt is a value of a reductant release counter, inc is a function that returns a value based on arguments (e.g., arg1=M1 and arg2=thr1), M1-M3 are metrics as previously described, and thr1-3 are thresholds as previously described. If the value of Re1_cnt is greater than a threshold, release of reductant may be indicated.

If method 300 judges that the plurality of metrics indicates release of reductant from the injector, the answer is yes and method 300 proceeds to 316. Otherwise, the answer is no and method 300 proceeds to exit.

At 316, method 300 provides an indication of release of reductant from the injector of the exhaust system. Method 300 may display a message to vehicle occupants via a human/machine interface. In some examples, method 300 may transmit an indication of release of reductant to a remote device. In addition, method 300 may adjust vehicle operating conditions in response to an indication of release of reductant from the injector. For example, method 300 may advance timing of fuel that is injected into the engine to reduce engine feed gas temperatures. Method 300 may also limit or restrict boost pressure to less than a threshold pressure to reduce engine feed gas temperatures. In still other examples, method 300 may adjust an amount of exhaust gas recirculation to limit exhaust temperatures. By limiting exhaust temperatures, temperature of after treatment devices (e.g., DEC and DPF) may be limited during conditions of unintended reductant release. Method 300 proceeds to exit.

Thus, the method of FIG. 3 provides for an engine operating method, comprising: generating a plurality of metrics via a controller, the plurality of metrics including an oxygen concentration difference and a temperature difference across an emissions device; and adjusting engine operation in response to a release of reductant from an injector positioned in an exhaust system, where the release is based on the plurality of metrics being compared to one or more thresholds that are functions of one or more engine parameters. The engine method includes where the one or more engine parameters include ambient pressure and temperature, exhaust flow, and feed gas temperature. The engine method includes where the plurality of metrics include and oxygen concentration metric. The engine method includes where the plurality of metrics include a temperature difference across a diesel exhaust catalyst. The engine method includes where the plurality of metrics include a temperature difference across a particulate filter and the diesel exhaust catalyst. The engine method includes where the plurality of metrics are sub-metrics of a metric that includes the sub-metrics. The engine method includes where adjusting engine operation includes lowering or limiting exhaust gas temperatures via adjusting injection timing and boost pressure. The engine method includes where the release occurs without commanding the release, and where the release includes release of hydrocarbons.

The method of FIG. 3 also provides for an engine operating method, comprising: generating a plurality of metrics via a controller, the plurality of metrics including an oxygen concentration difference and a temperature difference across an emissions device; and adjusting engine operation in response to a release of reductant from an injector positioned in an exhaust system, wherein the release is based on the plurality of metrics being compared to one or more thresholds that are functions of one or more engine parameters, and wherein the thresholds are adjusted such that at least one of the one or more thresholds is automatically exceeded for ambient temperatures that are less than a threshold temperature. The engine method further comprises a counter including a count value that increases as a function of a metric's deviation from the threshold temperature, and instructions to indicate release from the injector responsive to the count value exceeding a threshold count value. The engine method includes where adjusting engine operation includes reducing engine exhaust temperature. The engine method includes where adjusting engine operation includes reducing engine boost pressure. The engine method includes where the oxygen concentration difference is based on output of an oxygen sensor positioned in an exhaust system upstream of an injector and output of an oxygen sensor positioned in the exhaust system downstream of the injector.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. Further, portions of the methods may be physical actions taken in the real world to change a state of a device. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example examples described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller. One or more of the method steps described herein may be omitted if desired.

It will be appreciated that the configurations and routines disclosed herein are exemplary in nature, and that these specific examples are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine operating method, comprising:

injecting a reductant into an exhaust system of an engine upstream of a diesel exhaust catalyst via an injector;

deactivating the injector and generating a plurality of metrics via a controller in response to an amount of carbonaceous soot stored in a diesel particulate filter being less than a threshold amount or a temperature of the diesel particulate filter being greater than a threshold temperature, the plurality of metrics including an oxygen concentration difference and a temperature difference across the diesel exhaust catalyst; and adjusting engine operation in response to a release of reductant from the injector after the injector is deactivated, where the release is determined based on the plurality of metrics being compared to one or more thresholds that are functions of one or more engine parameters.

2. The engine method of claim 1, where the one or more engine parameters include ambient pressure and temperature, exhaust flow, and feed gas temperature.

3. The engine method of claim 1, where the oxygen concentration difference is the oxygen concentration difference across the injector.

4. The engine method of claim 1, where the plurality of metrics further includes a metric of a temperature difference across both of the diesel particulate filter and the diesel exhaust catalyst.

5. The engine method of claim 4, where the plurality of metrics further includes a metric that is a sum of the temperature difference across the diesel exhaust catalyst and the metric of the temperature difference across both of the diesel particulate filter and the diesel exhaust catalyst.

6. The engine method of claim 1, where adjusting engine operation includes lowering or limiting exhaust gas temperatures via adjusting an injection timing and boost pressure.

7. The engine method of claim 6, where the release occurs without commanding the release, and where the release includes release of hydrocarbons.

8. An engine system, comprising:

an internal combustion engine;

an after treatment system coupled to the internal combustion engine, the after treatment system including an oxidation catalyst, a particulate filter, and an injector;

a first oxygen sensor positioned in the after treatment system upstream of the injector and a second oxygen sensor positioned in the after treatment system downstream of the injector;

a first temperature sensor positioned upstream of the oxidation catalyst and a second temperature sensor positioned downstream of the oxidation catalyst, and a third temperature sensor positioned downstream of the particulate filter; and controller including executable instructions stored in a non-transitory memory that cause the controller to generate a plurality of metrics for assessing a release from the injector, the plurality of metrics including a temperature difference across both of the particulate filter and the oxidation catalyst, and additional executable instructions stored in the non-transitory memory that cause the controller to generate the plurality of metrics in response to an amount of carbonaceous soot stored in the particulate filter being less than a threshold amount or a temperature of the particulate filter being greater than a threshold temperature.

9. The engine system of claim 8, where the second oxygen sensor is positioned downstream of the oxidation catalyst, where the plurality of metrics further includes a temperature difference across the oxidation catalyst, and where the plurality of metrics further include a metric that is a sum of a first metric and a second metric, the first metric being the temperature difference across both of the particulate filter and the oxidation catalyst, and the second metric being the temperature difference across the oxidation catalyst.

10. The engine system of claim 8, where the plurality of metrics further includes a change in oxygen concentration.

11. The engine system of claim 10, wherein the additional executable instructions further comprise to compare the plurality of metrics to a plurality of thresholds.

12. The engine system of claim 11, where the plurality of thresholds are based on an exhaust flow rate, an ambient temperature, and an ambient pressure.

13. The engine system of claim 10, wherein the additional executable instructions further comprise a counter including a count value that increases as a function of a metric's deviation from a threshold value, and instructions to indicate the release from the injector responsive to the count value exceeding a threshold count value.

14. An engine operating method, comprising:

generating a plurality of metrics via a controller, the plurality of metrics including an oxygen concentration difference and a temperature difference across an emissions device; and adjusting engine operation in response to a release of reductant from an injector positioned in an exhaust system, wherein the release is based on the plurality of metrics being compared to one or more thresholds that are functions of one or more engine parameters, and wherein the one or more thresholds are adjusted such that at least one of the one or more thresholds is automatically exceeded by one of the plurality of metrics for ambient temperatures that are less than a threshold temperature.

15. The engine method of claim 14, wherein the controller further comprises a counter including a count value that increases as a sum of functions based on the plurality of metrics increases, and instructions to indicate the release from the injector responsive to the count value exceeding a threshold count value.

16. The engine method of claim 14, where adjusting engine operation includes reducing engine exhaust temperature.

17. The engine method of claim 16, where adjusting engine operation includes reducing engine boost pressure.

18. The engine method of claim 14, where the oxygen concentration difference is based on an output of an oxygen sensor positioned in the exhaust system upstream of the injector and an output of an oxygen sensor positioned in the exhaust system downstream of the injector.

* * * * *